United States Patent [19]

Hammer et al.

[11] 4,321,502

[45] Mar. 23, 1982

[54] U-SHAPED DISCHARGE LAMP WITH STARTING STRIP

[75] Inventors: Edward E. Hammer, Mayfield Village; Eugene Lemmers, Cleveland Heights, both of Ohio

[73] Assignee: General Electric Company, Schenectady, N.Y.

[21] Appl. No.: 99,618

[22] Filed: Dec. 3, 1979

[51] Int. Cl.[3] ..... H01J 61/30; H01J 61/54

[52] U.S. Cl. ..... 313/198; 313/201; 313/220

[58] Field of Search ..... 313/201, 493, 492, 198, 313/234, 220

[56] References Cited

U.S. PATENT DOCUMENTS

| | | | |
|---|---|---|---|
| 1,517,466 | 12/1924 | Schaller et al. | 313/201 X |
| 2,053,879 | 9/1936 | Spanner et al. | 313/201 X |
| 2,262,177 | 11/1941 | Germer | 313/201 X |
| 2,542,345 | 2/1951 | Miles | 313/201 |
| 2,624,023 | 12/1952 | Noel et al. | 313/201 |
| 2,683,836 | 7/1954 | Lemmers . | |
| 2,733,371 | 1/1956 | Campbell . | |
| 2,795,724 | 6/1957 | Beeson | 313/198 |
| 3,548,241 | 12/1970 | Rasch et al. . | |
| 4,153,861 | 5/1979 | Warner et al. | 313/201 X |

FOREIGN PATENT DOCUMENTS

| | | | |
|---|---|---|---|
| 1044443 | 11/1958 | Fed. Rep. of Germany | 313/198 |
| 464343 | 4/1937 | United Kingdom | 313/198 |
| 904276 | 8/1962 | United Kingdom | 313/198 |

OTHER PUBLICATIONS

"Amglo Flashtube Eng. Manual", received and dated by Scientific Lib. of PTO., Aug. 7, 1972, pp. 11 and 12.

*Primary Examiner*—Palmer C. Demeo

*Attorney, Agent, or Firm*—Norman C. Fulmer; Lawrence R. Kempton; Philip L. Schlamp

[57] ABSTRACT

A U-shaped discharge lamp, such as a fluorescent lamp, is provided with a starting strip in the form of a pair of conductors respectively extending partially along the legs of the lamp, and an electrical connection is made between the conductors at one end thereof. This electrical connection can consist of or be combined with a support strap. An additional starting strip component can be provided on the U-bend portion of the lamp.

9 Claims, 3 Drawing Figures

U-SHAPED DISCHARGE LAMP WITH STARTING STRIP

BACKGROUND OF THE INVENTION

The field of invention is U-shaped discharge lamps, such as U-shaped fluorescent lamps, an example being known by the trademark "Mod-U-Line" lamps.

U.S. Pat. No. 3,548,241 to Rasch discloses a U-shaped fluorescent lamp construction of the type having a support strap clamped around the ends of the lamp to improve its rigidity. The lamp does not employ a starting strip. Starting strips are conventionally provided on straight fluorescent lamps, for reducing their starting voltage. U.S. Pat. No. 2,683,836 to Lemmers discloses a narrow starting strip of conductive material carried on a straight lamp bulb. The starting strip can also be in the form of a coating, usually inside the bulb, of a transapprent conductor such as tin oxide, or stannous chloride as disclosed in U.S. Pat. No. 2,733,371 to Campbell. Conventional starting strips are difficult and time-consuming to apply to U-shaped lamps, and if applied prior to bending the bulb into a U-shape the strip is likely to break or develop high resistance when the bulb is bent.

SUMMARY OF THE INVENTION

An object of the invention is to provide a new type of starting strip for U-shaped lamps which can be applied to the lamp easily and quickly and which is feasible for use in manufacturing the lamps.

The invention comprises, briefly and in a preferred embodiment, a U-shaped discharge lamp, and a starting strip therefor comprising a pair of conductors extending partially along the straight legs of the lamp, and an electrical connection between the conductors at one end thereof. The conductors and their electrical connection may comprise a single strip of material. Also, the electrical connection can consist of or be combined with a support strap. An additional starting strip component can be provided on the U-bend portion of the lamp.

DESCRIPTION OF THE PREFERRED EMBODIMENTS

Figure 1:
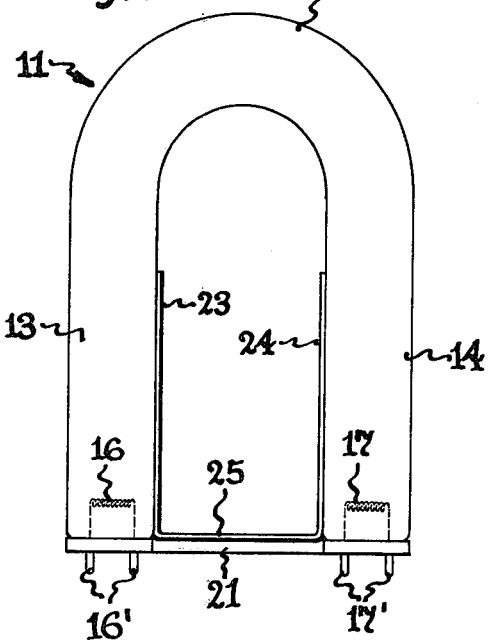
FIG. 1 is a side view of a preferred embodiment of the invention.
Figure 2:
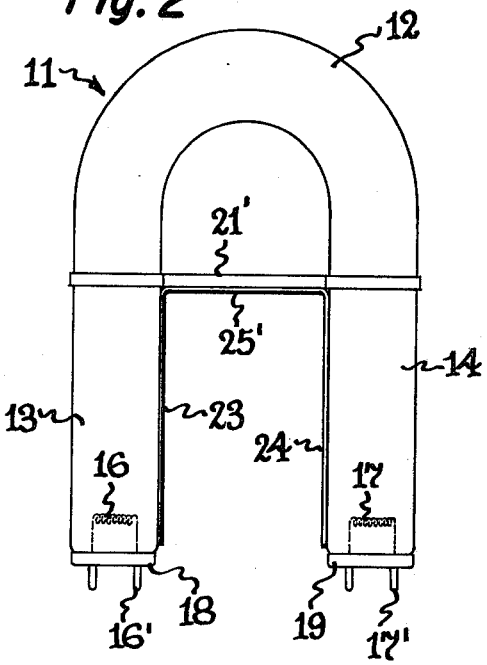
FIG. 2 is a side view of an alternative preferred embodiment of the invention.

The U-lamps of FIG. 1 comprises a U-shaped bulb 11 having a U-bend portion 12 and a pair of mutually parallel straight legs 13, 14. A pair of filaments 16 and 17 are respectively mounted in the bulb near the ends thereof, and respectively connected to pairs of connector terminals 16' and 17'. Conventionally, a pair of short cylindrical metal end caps 18 and 19 are cemented to the ends of the bulb, as best shown in FIG. 2. In FIG. 1, a support strap 21 is clamped at the ends thereof around the end caps 18 and 19, to provide ridigity to the lamp. The lamp described thus far is generally similar to that disclosed in the above-referenced Rasch patent. Conventionally the bulb 11 contains a quantity of mercury to provide a mercury vapor discharge path in the lamp. Also, a gas fill such as argon is provided in the bulb to aid in starting, or in more recent energy saving lamps the fill gas is a mixture or krypton and neon.

In accordance with the invention, the U-lamp is provided with a starting strip comprising a pair of conductors 23 and 24 respectively extending partially along the legs 13, 14 of the lamp, there being an electrical connection between these conductors at one end thereof, such as by means of a cross-wise conductor 25. In the preferred embodiment shown, the starting thin strips 23 and 24 and their cross-connect 25 comprise a single elongated strip of aluminized mylar plastic, about one-eights of an inch wide, with pressure sensitive contact adhesive on the aluminum side. The central connector portion 25 is first pressed against the side or edge of the support strap 21, and then the leg portions 23 and 24 are pressed against the lamp legs 13 and 14 on the mutually facing inside areas thereof. Alternatively, the starting strips 23 and 24 may be individual members which make contact with a metal support strap 21 which then functions as a cross-connector for the starting strips. In the preferred embodiment shown, the support strap 21 supplies support and protection for the cross-connector 25. Preferably the outer side of the starting strips 23 and 24 terminate near the vicinity of the filaments 16 and 17 or may extend to a point between the filaments and their respective ends of the lamp, as shown in the drawing. Also, preferably, the starting strips 23 and 24 extend at least half-way along the straight legs 13 and 14 of the lamp. Only one, but not both, corresponding ends of the starting strips 23 and 24 should be interconnected with a cross-connector 25. The starting strip of the invention reduces the starting voltage of the lamp, making it easier and more reliable to start, while at the same time avoiding the difficulty of applying the starting strip to the curved end region 12 of the lamp.

In the embodiment of FIG. 2, the cross-connector conductor 25' is provided at the ends of starting strips 23, 24 which are toward the U-bend 12 part of the lamp, and may be against or attached to a support strap 21' which adds rigidity to the lamp and also supports and protects the cross-conductor 25'. The embodiments of FIGS. 1 and 2 are about equally effective in reducing the starting voltage of the lamp.

Figure 3:
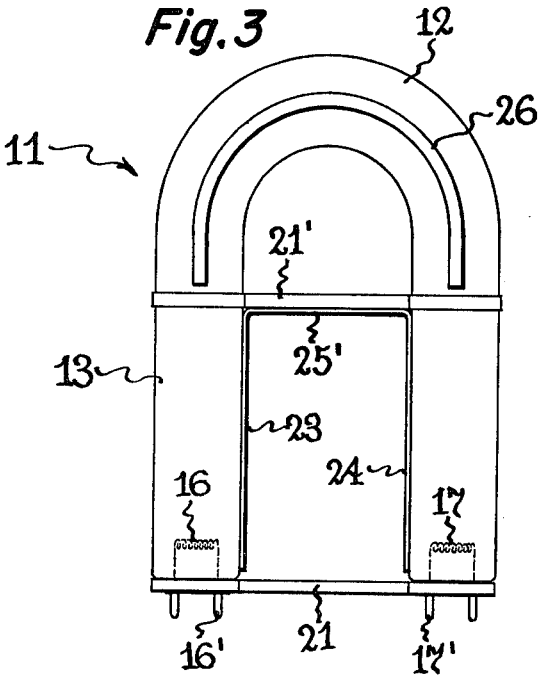
FIG. 3 is a side view of a modification of the embodiment of FIG. 2.

FIG. 3 is the same as FIG. 2, except that an additional starting strip element 26 has been added, on the U-bend portion 12 of the lamp. The additional conductor 26 may be placed on a flat plane or side of the U-bend, as shown, or may be placed on the outer or inner contour of the U-bend. The additional starting strip component 26 should be electrically floating, i.e., it should not make electrical contact with the starting strips 23 and 24 which are on the legs of the lamp. Also in FIG. 3 the support bracket 21 has been added, to increase the ridigity of the lamp.

Tests conducted on the above described embodiments, on U-shaped 40 watt lamps of the low energy type containing a fill gas mixture of krypton and neon, showed the following starting voltage results, as compared to a starting voltage of about 275 RMS volts without any starting strips on the lamp:

For the embodiment of FIG. 1, the starting voltage was 235 RMS volts, for embodiment of FIG. 2 the starting voltage was also 235 RMS volts, and for FIG. 3 was 225 RMS volts. Thus, while the embodiment of FIG. 3 showed a lower starting voltage by 10 volts over the embodiments of FIG. 1 and 2, the added manufacturing expense of applying the curved starting strip component 26 to the lamp might not justify its use if the lamps start satisfactorily at 235 RMS volts per the embodiments of FIGS. 1 and 2.

From the foregoing, it will be apparent that the objectives of the invention have been achieved, i.e., to provide a starting strip for U-shaped discharge lamps which is feasible and economical to manufacture, and which reduces the starting voltage for the lamp.

While preferred embodiments of the invention have been shown and described, various other embodiments and modifications thereof will become apparent to persons skilled in the art, and will fall within the scope of the invention as defined in the following claims.

What we claim as new and desire to secure by Letters Patent of the United States is:

1. A U-shaped discharge lamp comprising a bulb shaped to have a pair of substantially straight and mutually parallel legs joined by a U-bend, and starting strip means comprising a pair of conductive starting strips respectively extending along only a portion of said legs, and connector means extending laterally and spatially between and electrically interconnecting said pair of starting strips at corresponding ends thereof, the remaining ends of said starting strips being electrically unconnected.

2. A lamp as claimed in claim 1, in which said connector means interconnects the ends of said starting strips which are away from said U-bend of the lamp.

3. A lamp as claimed in claim 1, in which said connector means interconnects the ends of said starting strips which are toward said U-bend of the lamp.

4. A lamp as claimed in claim 3, including a starting strip member carried on said U-bend and having a U-shape, the ends of said last-named starting strip member extending near to but not touching the respective said starting strips.

5. A lamp as claimed in claim 1, in which said starting strips and connector means comprise a single strip of material.

6. A lamp as claimed in claim 1, including a support strap extending between and attached to said pair of legs, said connector means being combined with said support strap.

7. A lamp as claimed in claim 6, in which said starting strips and connector means comprise a single strip of material, said connector means extending along and being attached to said support strap.

8. A lamp as claimed in claim 1, in which said bulb contains a pair of cathodes respectively near to and spaced from said ends thereof, said connector means being in a plane lying between said cathodes and said bulb ends.

9. A lamp as claimed in claim 8, in which said plane is substantially at said bulb ends.

* * * * *